US007026955B2

(12) United States Patent
Kauffman

(10) Patent No.: US 7,026,955 B2
(45) Date of Patent: Apr. 11, 2006

(54) APPARATUS AND METHOD FOR ACTIVATING AN INDUCTANCE LOOP VEHICLE DETECTION SYSTEM

(75) Inventor: Scott Kauffman, 9736 SE. Stephens St., Portland, OR (US) 97216

(73) Assignee: Scott Kauffman, Portland, OR (US)

( * ) Notice: Subject to any disclaimer, the term of this patent is extended or adjusted under 35 U.S.C. 154(b) by 0 days.

(21) Appl. No.: 09/904,419

(22) Filed: Jul. 12, 2001

(65) Prior Publication Data

US 2002/0175833 A1 Nov. 28, 2002

(51) Int. Cl.
*G08G 1/01* (2006.01)

(52) U.S. Cl. ..... 340/941; 340/939; 340/936; 340/917; 340/448

(58) Field of Classification Search ..... 340/941, 340/939, 936, 938, 916, 905, 919, 917, 448
See application file for complete search history.

(56) References Cited

U.S. PATENT DOCUMENTS

| | | | | |
|---|---|---|---|---|
| 3,588,806 | A * | 6/1971 | Wilcox | 340/941 |
| 3,943,339 | A | 3/1976 | Koerner et al. | |
| 3,949,252 | A * | 4/1976 | Riesenberg et al. | 310/168 |
| 3,989,932 | A | 11/1976 | Koerner | |
| 4,038,633 | A * | 7/1977 | King | 340/941 |
| 4,430,636 | A | 2/1984 | Bruce | |
| 4,531,560 | A | 7/1985 | Balanky | |
| 4,568,937 | A * | 2/1986 | Clark | 340/939 |
| 4,668,951 | A | 5/1987 | Duley et al. | |
| 4,965,583 | A | 10/1990 | Broxmeyer | |
| 5,201,111 | A * | 4/1993 | Prohaska | 310/154.07 |
| 5,396,234 | A * | 3/1995 | Gebert et al. | 340/936 |
| 5,507,831 | A * | 4/1996 | Burke | 623/23.25 |
| 5,659,290 | A * | 8/1997 | Haeri | 340/441 |
| 5,936,551 | A | 8/1999 | Allen et al. | |
| 6,042,080 | A | 3/2000 | Shepherd et al. | |
| 6,345,228 | B1 * | 2/2002 | Lees | 701/117 |
| 6,378,772 | B1 * | 4/2002 | Yonemura | 235/384 |
| 6,466,862 | B1 | 10/2002 | DeKock et al. | |
| 6,535,143 | B1 * | 3/2003 | Miyamoto et al. | 340/933 |

OTHER PUBLICATIONS

Office Action dated Mar. 4, 2005 in related pending U.S. Appl. No. 10/877,636 (12 pages).

* cited by examiner

*Primary Examiner*—Jeffery Hofsass
*Assistant Examiner*—Daniel Previl
(74) *Attorney, Agent, or Firm*—Banner & Witcoff, Ltd.

(57) ABSTRACT

An apparatus and method for activating an inductance loop vehicle detection system is disclosed, wherein a magnet is attached to a vehicle. In order to activate the inductance loop vehicle detection system, the vehicle, and attached magnet, are moved in relation to an induction loop embedded within a roadway. A reaction between the magnet and induction loop causes the inductance loop vehicle detection system to register the presence of a vehicle.

59 Claims, 3 Drawing Sheets

APPARATUS AND METHOD FOR ACTIVATING AN INDUCTANCE LOOP VEHICLE DETECTION SYSTEM

FIELD OF THE INVENTION

The present invention relates to an apparatus and method for activating an inductance loop vehicle detector that senses vehicles located at an intersection for, e.g., triggering a traffic signal device. More particularly, this invention relates to a magnetic device, or a method that uses a magnetic device, which is attached to a vehicle and assists in activating an inductance loop vehicle detector.

BACKGROUND OF THE INVENTION

In order to regulate vehicular traffic in an efficient manner, intersections with traffic signals often include an inductance loop vehicle detection system that senses the presence of vehicles located at an intersection. The basic configuration of such a vehicle detection system includes an induction loop (e.g., a wire coil) that is located beneath a roadway. The induction loop is connected to a control box that includes one or more oscillators, an oscillation counter, and a traffic signal controller. The oscillator is used to produce an oscillating signal in the induction loop and the oscillation counter stores information relating to the frequency of the oscillation in the induction loop.

When a vehicle approaches an intersection with a vehicle detection system, conducting material (e.g. metal) in the vehicle decreases the inductance of the induction loop, thereby increasing the oscillation frequency of the detection system. The decrease in inductance occurs because the conducting material in the vehicle acts as a shortened turn in the induction loop. To determine whether a vehicle is present at the intersection, the vehicle detection system compares the current oscillation frequency with a prior oscillation frequency. If the current oscillation frequency is greater than the prior oscillation frequency, a vehicle may be present. If, however, the current oscillation frequency is less than or equal to the prior oscillation frequency, then it is likely that a vehicle is not present at the intersection.

Between successive oscillation counts, a vehicle may enter an intersection, remain at an intersection, or leave an intersection. If the oscillation counter senses an increase in oscillation frequency, a control signal is generated in order to alert the traffic signal controller of the presence of a vehicle. Generally, the traffic signal controller will respond to the control signal after a preset delay period by changing the traffic signal configuration (e.g., from a red traffic light signal to a green traffic light signal). If the traffic signal controller has not altered the traffic signal configuration and a succeeding oscillation count remains at the higher level, the detection system generates a control signal to alert the traffic signal controller of the continued presence of a vehicle. Similarly, if a succeeding oscillation count returns to a base level, the detection system generates a control signal to alert the traffic signal controller of the vehicle's departure, thereby eliminating the need for a change in the traffic signal's configuration.

In addition to vehicles that are located proximal to the inductance loop, environmental factors may affect the inductance of the loop. In multi-lane intersections, vehicles stopped in one lane may alter the inductance of a loop located in a neighboring lane. Where intersections are located near train tracks, the presence of a train may also affect loop inductance. Further, fluctuations in electrical load may alter the inductance properties of the loop. Accordingly, inductance loop vehicle detection systems are often calibrated such that small changes in oscillation frequency do not generate a signal that affects the traffic signal configuration. Only changes in frequency that are above a preset level will affect the operation of the traffic signal controller.

A common, detrimental effect of the calibration is that vehicles with a relatively small quantity of conducting material, including bicycles, motorcycles, and smaller automobiles, do not cause an inductance sufficient to alter the oscillation frequency of commonly used vehicle detection systems beyond the calibrated level. When such a vehicle enters an intersection with an inductance loop detection system, the detection system does not generate a control signal to alert the traffic signal controller of the vehicle's presence. Accordingly, there is a need in the art for an apparatus and/or method that may be used in conjunction with vehicles that have a relatively small quantity of conducting material to activate inductance loop vehicle detection systems.

BRIEF SUMMARY OF THE INVENTION

Advantageously, some embodiments of the present invention provide an apparatus for activating an inductance loop vehicle detector. The apparatus includes a magnet and a mount that attaches the magnet to a vehicle. In one preferred embodiment, the magnet is a grade 5 ceramic magnet having a total flux of at least 20,000 maxwells, a maximum energy product of 6.5 MGOe or greater, a residual induction of at least 3000 gauss, and a coercive force of at least 2200 oersteds. For some preferred embodiments, a coating may be applied to the magnet to increase its aesthetic properties and provide protection from corrosion or wear. Also, with some embodiments of the invention, the mount is used to secure the magnet to a portion of the vehicle that is in close proximity to the underlying roadway and thus to an inductance loop embedded within the roadway.

The apparatus may be used to retrofit existing vehicles or may be added during manufacture of a new vehicle. In either respect, the vehicle and attached magnet may be moved in proximity to an induction loop vehicle detection system, to thereby prompt a change in an associated traffic light configuration and thus provide the driver of the vehicle with, e.g., a green traffic signal light.

Various advantages and features of novelty that characterize the invention are pointed out with particularity in the claims. For a better understanding of the invention and its advantages, however, reference should be made to the attached drawings and to the accompanying descriptive matter, in which there is illustrated and described preferred embodiments of the invention.

DETAILED DESCRIPTION OF THE INVENTION

Figure 1:
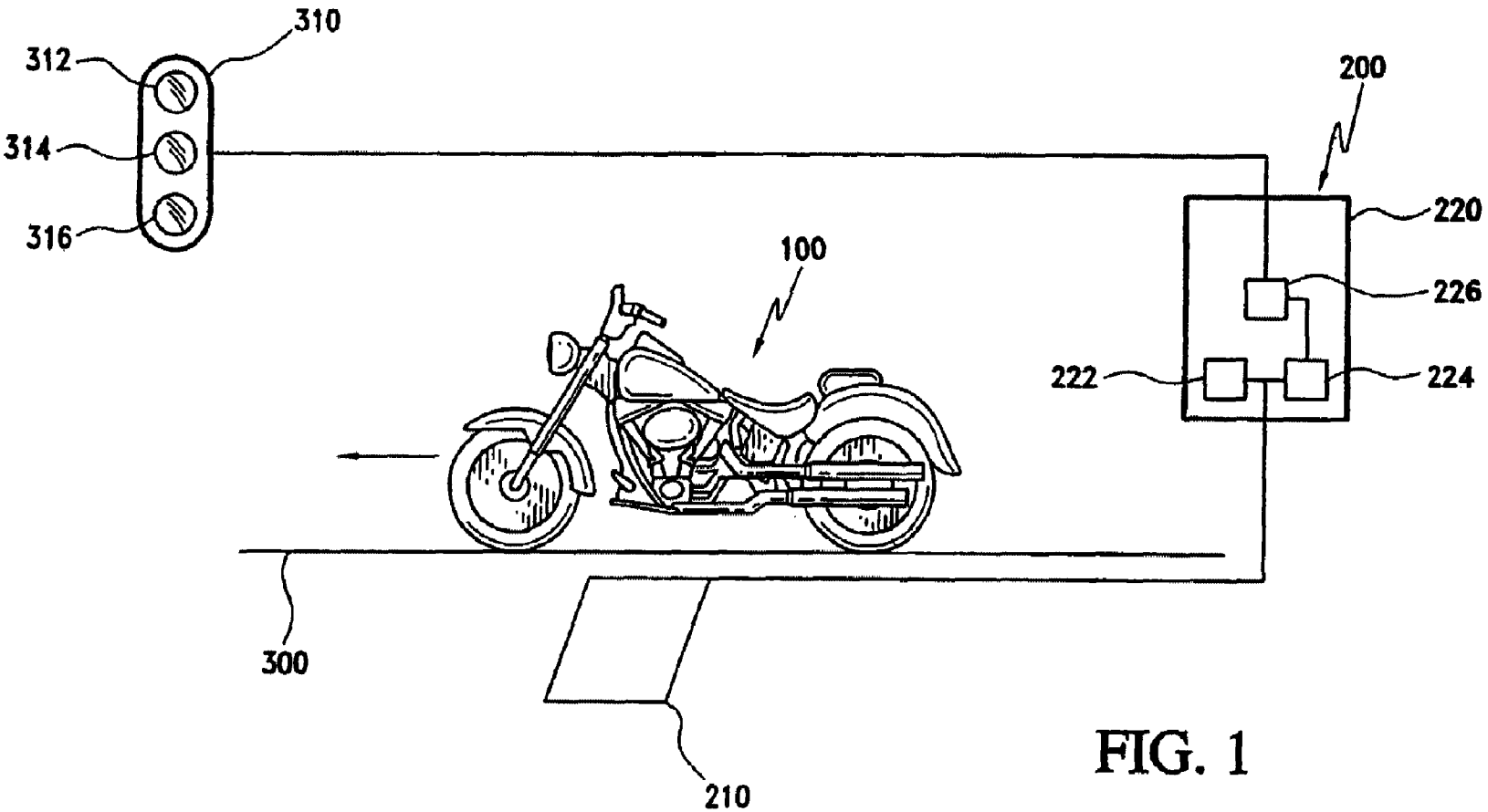
FIG. 1 is a pictorial view depicting the conventional relationship between a vehicle, an inductance loop vehicle detection system, and a traffic signal.

FIG. 1 depicts a vehicle 100 passing over an inductance loop 210 that is embedded in a roadway 300. Vehicle 100 is depicted as a motorcycle, but may be any type of vehicle, including an automobile, motorized scooter, or bicycle. Vehicle detection system 200 includes an inductance loop 210 and a control unit 220. Inductance loop 210 may be any type of inductance loop conventionally used for vehicle detection applications. Control unit 220 is connected to inductance loop 210 and includes one or more oscillators 222, an oscillation counter 224, and a traffic signal controller 226. Traffic signal controller 226 is connected to traffic signal 310 and controls the configuration of the traffic signal's red light 312, yellow light 314, and green light 316. Of course, those of ordinary skill in the art will appreciate that other types of traffic signals may employ different light colors and configurations (e.g., changing from a solid yellow light to a blinking yellow light in the presence of a vehicle).

The purpose of vehicle detection system 200 is to detect vehicles, such as vehicle 100, located on the roadway 300 proximal to inductance loop 210. If vehicle 100 is not in close proximity to inductance loop 210, oscillator 222 produces oscillations at a base frequency. The presence of vehicle 100, which is partially formed of a conducting material, near inductance loop 210 acts as a shortened turn for the loop, thereby altering the inductance of induction loop 210 and increasing the frequency of oscillations produced by oscillator 222. Oscillation counter 224 senses the increased oscillation frequency and sends a control signal to traffic signal controller 226 that indicates the presence of vehicle 100. Traffic signal controller 226 then controls the configuration of traffic signal 310 such that green light 316 is illuminated after a preset period, thereby indicating that vehicle 100 may proceed through the intersection.

In some applications, the vehicle detection system 200 may be calibrated such that oscillation counter 224 does not send a control signal to traffic signal controller 226 for only relatively small changes in oscillation frequency. The purpose of the calibration is to prevent environmental effects, such as vehicles in neighboring traffic lanes or the presence of a train on a nearby track, from erroneously triggering a change in the configuration of traffic signal 310. Many vehicles, however, have a quantity of conducting material that is insufficient to alter the oscillation frequency of inductance loop 210 beyond the calibrated level, and thus may be unable to trigger the vehicle detection system 200. Accordingly, these vehicles may not gain the necessary green light 316 that permits such vehicles to proceed through an intersection.

Figure 2:
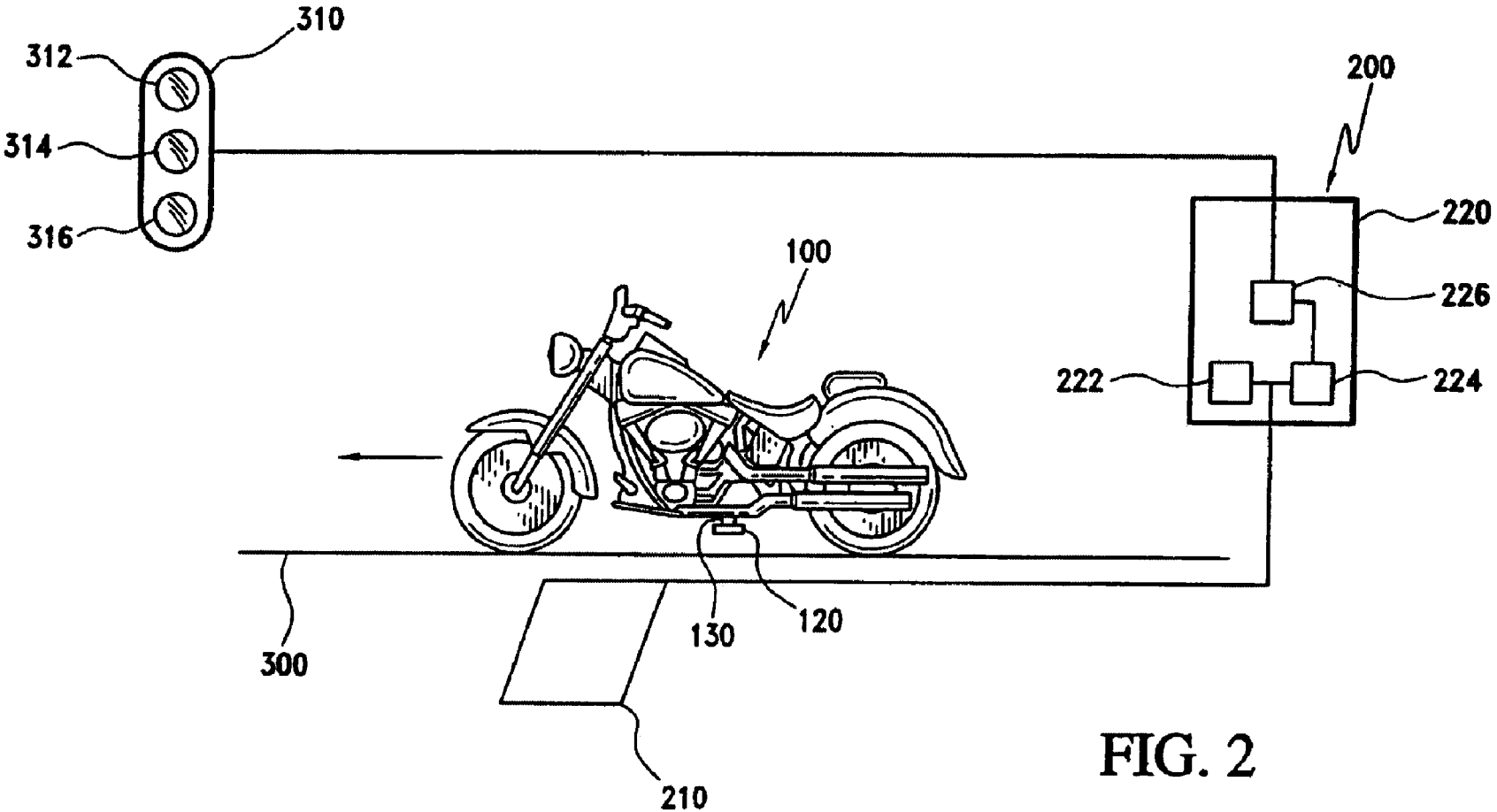
FIG. 2 is a pictorial view of the components of one preferred embodiment of the present invention.

With reference to FIG. 2, vehicle 110 is depicted as a motorcycle, but may be any type of vehicle with a relatively small quantity of conducting material, including an automobile, motorized scooter, or bicycle. Located on vehicle 110 and near roadway 300 is magnet 120. As will be discussed in detail below, mounting the magnet 120 on the vehicle 110 such that it moves with the vehicle 110 in close proximity to induction loop 210 affects the properties of vehicle detection system 200 in such a manner as to cause the vehicle detection system 200 to register the presence of the vehicle 110, even if the vehicle 210 would otherwise not have sufficient conductive material to trigger the detection system 200. Accordingly, an altered configuration of traffic signal 310 may be achieved if vehicle 110 is in motion above induction loop 210 for at least a short duration. Sufficient motion, for example, may occur when vehicle 110 moves over induction loop 210 before coming to a stop in compliance with an illuminated red light 312.

Figure 3:
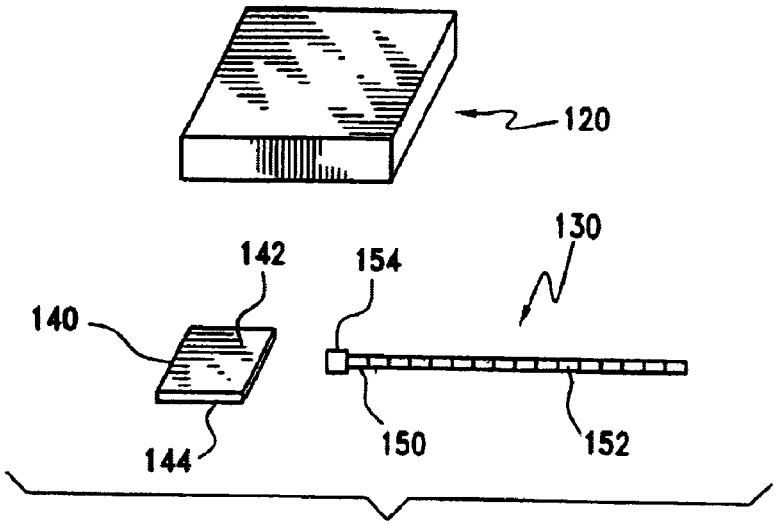
FIG. 3 is a perspective view of the components of one preferred embodiment of the present invention.

One aspect of the present invention relates to an apparatus that causes an induction loop detection system 200 to register the presence of a vehicle, regardless of the amount of conductive material actually present in the vehicle. As depicted in more detail in FIG. 3, the primary components of one embodiment of the present invention include permanent magnet 120 and mount 130. As shown in this figure, mount 130 includes adhesive element 140 and tie 150.

With some preferred embodiments of the invention, magnet 120 is a grade 5 permanent ceramic magnet having a total flux of at least 20,000 maxwells, a maximum energy product of 6.5 MGOe or greater, a residual induction of at least 3000 gauss, and a coercive force of at least 2200 oersteds. As is well known in the art, a permanent ceramic magnet is described by the general formula $MO◆6Fe_2O_3$, where M generally represents barium or strontium or a combination of barium and strontium. The magnet 120 may have a box-like shape with a length of approximately 1⅞ inches, a width of approximately ⅞ inch, and a height of approximately ⅜ inch. With these properties, magnet 120 was experimentally determined to register the presence of a vehicle at approximately 90% of the intersections that use a vehicle detection system like vehicle detection system 200 described above. Of course, those of ordinary skill in the art will appreciate that the magnet 120 may have any size and shape suitable to its use on a desired vehicle. Moreover, as is known in the art, the shape of the magnet 120 may be selected to produce improved magnetic characteristics in a desired direction (e.g., in a direction toward the bottom of the vehicle and the induction loop detector).

With some preferred embodiments of the invention, magnet 120 should be mounted on vehicle 110 so as to be in close proximity to roadway 300, to thereby maximize the effect of the magnet 120 upon induction loop 210 located in roadway 300. The experimentally determined 90% effectiveness noted above was achieved at a distance of approximately 8 inches from the upper surface of roadway 300. For motorcycles, magnet 120 may thus be mounted on a centerstand crossbrace. With respect to bicycles, possible mounting locations include the pedal and crank.

With various embodiments of the invention, a coating may be applied to the outer surface of magnet 120 in order to, e.g., improve the overall durability of the magnet 120. For some applications of an apparatus according to the invention, the mounting placement of the magnet 120 (e.g., in close proximity to the surface of roadway 300), may expose magnet 120 to water, air borne debris, and other potential hazards. An appropriate coating may thus be used to help protect magnet 120 from corrosion and prevent breakage from objects that may contact magnet 120. A variety of coatings suitable for ceramic magnets, including conductive coatings (e.g., nickel or tin plating) and non-conductive coatings (e.g., Teflon, plastic, or rubber), may be employed. In addition to a coating, magnet 120 may be alternately or additionally be encased in a box or other protective casing.

The addition of a coating or other casing also provides a means for altering the aesthetic properties of magnet 120. The location in which magnet 120 may be mounted on vehicle 110 may be visible to those who may view vehicle 110. Accordingly, a coating color that matches the color of vehicle 110 or has the coloration of chrome may be used to permit magnet 120 to aesthetically blend into vehicle 110.

Although the magnet 120 is described above as a permanent ceramic magnet, it should be noted that any type of magnetic may be employed in accordance with the invention. For example, the magnet 120 may alternately be chosen from any of the other common families of commercially available permanent magnets, including alnico (aluminum-nickel-cobalt) magnets, rare earth neodymium-iron-boron magnets, and rare earth cobalt magnets. The magnet 120 may also be an electromagnet. Advantageously, an electromagnet may provide a higher magnetic strength than may be achieved in relation to permanent magnets. An electromagnet may be connected to the vehicle's battery, if available, or it may have a separate battery. An electromagnet being used as magnet 120 may also be driven by the operation of the vehicle itself (e.g., by motion of the vehicle's crankshaft, motion of the vehicle's wheels, etc.).

Mount 130 serves the purpose of securing magnet 120 to vehicle 110. A portion of mount 130, according to one embodiment of the present invention, is adhesive element 140. More particularly, the adhesive element 140 is a foam member having adhesive surface 142 and an opposite adhesive surface 144. In order to mount magnet 120 to vehicle 110 using adhesive element 140, adhesive surface 142 is brought into contact with a surface of magnet 120, thereby adhering adhesive surface 142 to magnet 120. Adhesive surface 144 is then brought into contact with a portion of vehicle 110, thereby adhering adhesive surface 144 to vehicle 110 and effectively mounting magnet 120 on vehicle 110. Alternatively, as adhesive surface 142 is substantially the same as adhesive surface 144, adhesive surface 142 may be adhered to vehicle 110 and adhesive surface 144 may be adhered to magnet 120.

In addition to adhesive element 140, mount 130 may include tie 150. Tie 150 includes corrugated strand 152 formed from, e.g., plastic or metal, and aperture 154. In order to mount magnet 120 to vehicle 110 using tie 150, magnet 120 is positioned on vehicle 110 and corrugated strand 152 is wrapped around both magnet 120 and the portion of vehicle 110 to which magnet 120 is to be mounted. The end of corrugated strand 152 is then inserted into aperture 154 until corrugated strand 152 secures the position of magnet 120. As is well known in the art, a resistance mechanism within aperture 154 prevents corrugated strand 152 from being retracted once inserted into aperture 154. The tie 150 can be used to supplement the holding ability of the adhesive element 140.

Other mounts may be suitable in addition to adhesive element 140. For example, depending upon the shape of the magnet 120, the tie 150 alone can be used as the mount 130 to securely attach the magnet 120 to the vehicle 110. The mount 130 may also be an adhesive material, such as a silicon adhesive paste, brackets that are secured to vehicle 110 using screws or bolts, or a hook and loop fastening system that permits magnet 120 to be interchanged between multiple vehicles 110. The mount 130 may be a permanent mount, or it may removably securely affix the magnet 120 to the vehicle 110.

Figure 4:
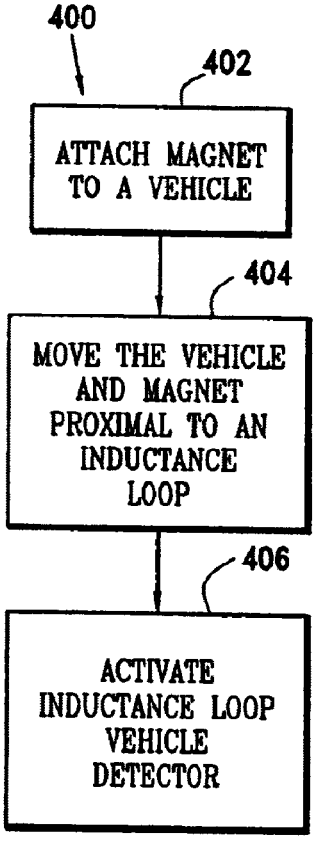
FIG. 4 is a schematic depicting a first method of the present invention.

As will be appreciated from the foregoing discussion, a method according to the invention includes the use of magnet 120 with a vehicle to trigger an induction loop detection system into indicating the presence of a vehicle. One embodiment of such a method is depicted schematically in FIG. 4. As seen in this figure, the method 400 includes securely attaching the magnet 120 to the vehicle 110 in step 402. The magnet 120 may be attached to the vehicle through the mount 130, as discussed in detail above. Alternatively, the magnet may be securely attached to the vehicle using the attractive properties of the magnet alone, depending upon the composition of the portion of the vehicle to which the magnet is mounted. For example, if the vehicle 110 is a motorcycle with an iron or steel centerstand crossbrace, and the attractive force of the magnet 120 is sufficiently strong to securely hold the magnet 120 to the motorcycle while still exerting sufficient magnetic energy in the direction of the roadway 300 (i.e., toward the induction loop detection system 200), then the mount 130 may be omitted. Further, if the vehicle 110 provides a convenient location where the magnet 120 can be wedged or supported by gravity so as to be securely attached to the vehicle 110, then these attachment techniques may also be employed in place of (or in addition to) the mount 130.

Next, in step 404, the vehicle 110, with the attached magnet 120, is moved proximal to the inductance loop vehicle detection system 200. Then, in step 406, the magnetic energy of the magnet 120 causes the inductance loop vehicle detection system 200 to register the presence of a vehicle. In response, the inductance loop vehicle detection system 200 may issue a signal to another device, e.g., a control signal to traffic signal 310, to report the presence of a vehicle.

Figure 5:
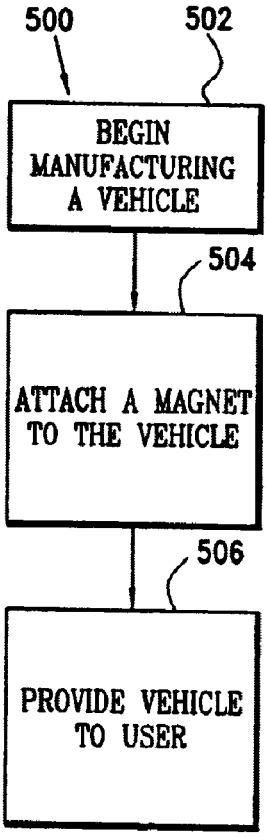
FIG. 5 is a schematic depicting a second method of the present invention.

With reference to FIG. 5, this figure schematically illustrates another method according to the invention, for manufacturing a vehicle 110. The method 500 includes the step 502 of beginning the manufacture of the vehicle 110. The method 500 also includes the step 504 of attaching the magnet 120 to the vehicle, so that the magnet 120 will activate an inductance loop detector. As previously noted, the magnet 120 can be attached to the vehicle 110 in a position that will be close to roadway 300 when the vehicle is in use. As also previously noted, the magnet 120 can be attached to the vehicle 110 using mount 130, the magnetic attractive force of the magnet 120 itself, by gravity or any other suitable force. In addition, the mount 130 can be formed integrally with the vehicle 110. For example, the vehicle 110 may be formed with a bracket or recess for holding the magnet 120. It should be noted that the manufacturer may attach magnet 120 to the vehicle at any desirable stage during manufacture of the vehicle 110. Next, in step 506, the vehicle 110 is provided to a user for use.

Figure 6:
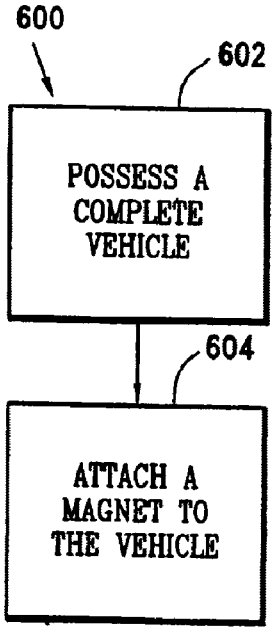
FIG. 6 is a schematic depicting a third method of the present invention.

FIG. 6 depicts a still another method 600 according to the invention, for retrofitting a vehicle 110 to include the magnet 120. The method 600 includes possessing or obtaining the vehicle 110 in step 602, and then attaching the magnet 120 to the vehicle 110 for the purposes of activating an inductance loop vehicle detector in step 604. As previously noted, the mount 130 may be used to attach the magnet 120 to the vehicle 110. Alternately, a sufficiently strong attachment may be made through the attractive force of the magnet alone. As was also previously described, the magnet 120 can be attached to the vehicle 110 using mount 130, the magnetic attractive force of the magnet 120 itself, by gravity or any other suitable force. Thus, according to the method 600 of the invention, a vehicle 110 that would not otherwise trigger a vehicle detection system 200 may be retrofitted so as to activate such a system.

The present invention has been described above by way of specific exemplary embodiments, and the many features and advantages of the present invention are apparent from the written description. Thus, it is intended that the appended claims cover all such features and advantages of the invention. Further, since numerous modifications and changes will readily occur to those skilled in the art, the specification is not intended to limit the invention to the exact construction and operation as illustrated and described. For example, while magnet 120 has been described above as an individual magnet, those of ordinary skill in the art will appreciate that the magnet 120 may be embodied by a plurality of magnets operating working together. Also, the invention may include any one or more elements from the apparatus and methods described herein in any combination or subcombination. Accordingly, there are any number of alternative combinations for defining the invention, which incorporate one or more elements from the specification (including the drawings, claims, and summary of the invention) in any combinations or subcombinations. Hence, all suitable modifications and equivalents may be considered as falling within the scope of the appended claims.

What is claimed is:

1. An apparatus for activating an inductance loop vehicle detector, comprising:

a permanent magnet, and a mount for attaching the magnet to a vehicle at a position that will cause the magnet to activate an inductance loop vehicle detector when the vehicle moves proximal to an inductance loop of the inductance loop vehicle detector.

2. The apparatus of claim 1, wherein the vehicle is selected from a group consisting of: a motorcycle, an automobile, and a bicycle.

3. The apparatus of claim 2, wherein the magnet is selected from the group consisting of: a ceramic magnet, a neodymium-iron-boron magnet, a samarium-cobalt magnet, and a magnet formed of an alloy of aluminum, nickel, and cobalt.

4. The apparatus of claim 2, wherein the magnet is a grade 5 ceramic magnet.

5. The apparatus of claim 1, wherein the magnet has a total flux of at least 20,000 maxwells and a maximum energy product of at least 6.5 MGOe.

6. The apparatus of claim 5, wherein the magnet further has a residual induction of at least 3000 gauss, and a coercive force of at least 2200 oersteds.

7. The apparatus of claim 1, wherein the magnet includes a protective coating.

8. The apparatus of claim 7, wherein the coating is a conducting material.

9. The apparatus of claim 7, wherein the coating is one or more of the group consisting of: tin, nickel, or chrome.

10. The apparatus of claim 7, wherein the coating is a non-conductive material.

11. The apparatus of claim 10, wherein the coating is formed from plastic or rubber.

12. The apparatus of claim 1, wherein the mount is selected from the group consisting of: an adhesive material, brackets, and a hook and loop fastener.

13. The apparatus of claim 1, wherein the mount includes a member having an adhesive coating on two opposing surfaces.

14. The apparatus of claim 1, wherein the mount includes a corrugated tie.

15. The apparatus of claim 1, wherein the mount is integrally formed with the vehicle.

16. A method of activating an inductance loop vehicle detector, comprising:

attaching a permanent magnet to a vehicle at a position on the vehicle that will cause the magnet to activate an inductance loop vehicle detector when the vehicle moves proximal to an inductance loop of the inductance loop vehicle detector, and moving the vehicle with the magnet proximal to an inductance loop of the inductance loop vehicle detector.

17. The method of claim 16, wherein the magnet is selected from the group consisting of: a ceramic magnet, a neodymium-iron-boron magnet, a samarium-cobalt magnet, and a magnet formed of an alloy of aluminum, nickel, and cobalt.

18. The method of claim 16, wherein the magnet is a grade 5 ceramic magnet.

19. The method of claim 16, wherein the magnet has a total flux of at least 20,000 maxwells and a maximum energy product of at least 6.5 MGOe.

20. The method of claim 19, wherein the magnet further has a residual induction of at least 3000 gauss, and a coercive force of at least 2200 oersteds.

21. The method of claim 16, wherein the magnet includes a protective coating.

22. The method of claim 21, wherein the coating is a conducting material.

23. The method of claim 21, wherein the coating is one or more of the group consisting of: tin, nickel, or chrome.

24. The method of claim 21, wherein the coating is a non-conductive material.

25. The method of claim 24, wherein the coating is formed from plastic or rubber.

26. The method of claim 16, wherein the magnet is attached using a mount.

27. The method of claim 26, wherein the mount is selected from the group consisting of: an adhesive material, brackets, and a hook and loop fastener.

28. The method of claim 26, wherein the mount includes a member having an adhesive coating on two opposing surfaces.

29. The method of claim 26, wherein the mount includes a corrugated tie.

30. The method of claim 26, wherein the mount is integrally formed with the vehicle.

31. A method far manufacturing a vehicle, comprising:

manufacturing a vehicle; and attaching a permanent magnet to the vehicle at a position on the vehicle that will cause the magnet to activate an inductance loop vehicle detector when the vehicle moves proximal to an inductance loop of the inductance loop vehicle detector for purposes of activating proximal inductance loop detectors.

32. The method of claim 31, wherein the magnet is selected from the group consisting of: a ceramic magnet, a neodymium-iron-boron magnet, a samarium-cobalt magnet, and a magnet formed of an alloy of aluminum, nickel, and cobalt.

33. The method of claim 31, wherein the magnet is a grade 5 ceramic magnet.

34. The method of claim 31, wherein the magnet has a total flux of at least 20,000 maxwells and a maximum energy product of at least 6.5 MGOe.

35. The method of claim 34, wherein the magnet further has a residual induction of at least 3000 gauss, and a coercive force of at least 2200 oersteds.

36. The method of claim 31, wherein the magnet includes a protective coating.

37. The method of claim 36, wherein to coating is a conducting material.

38. The method of claim 37, wherein the coating is one or more of the group consisting of: tin, nickel, or chrome.

39. The method of claim 36, wherein the coating is a non-conductive material.

40. The method of claim 39, wherein the coating is formed from plastic or rubber.

41. The method of claim 31, wherein the magnet is attached using a mount.

42. The method of claim 41, wherein the mount is selected from the group consisting of: an adhesive material, brackets, and a hook and loop fastener.

43. The apparatus of claim 41, wherein the mount includes a member having an adhesive coating on two opposing surfaces.

44. The apparatus of claim 41, wherein the mount includes a corrugated tie.

45. The apparatus of claim 41, wherein the mount is integrally formed with the vehicle.

46. A method of retrofitting a vehicle, comprising:

attaching a permanent magnet to a vehicle at a position on the vehicle that will cause the magnet to activate an inductance loop vehicle detector when the vehicle moves proximal to an inductance loop of the inductance loop vehicle detector.

47. The method of claim 46, wherein the magnet is selected from the group consisting of: a ceramic magnet, a neodymium-iron-boron magnet, a samarium-cobalt magnet, and a magnet formed of an alloy of aluminum, nickel, and cobalt.

48. The method of claim 47, wherein the magnet is a grade 5 ceramic magnet.

49. The method of claim 46, wherein the magnet has a total flux of at least 20,000 maxwells and a maximum energy product of at least 6.5 MGOe.

50. The method of claim 49, wherein the magnet further has a residual induction of at least 3000 gauss, and a coercive force of at least 2200 oersteds.

51. The method of claim 46, wherein the magnet includes a protective coating.

52. The method of claim 51, wherein the coating is a conducting material.

53. The method of claim 52, wherein the coating is one or more of the group consisting of: tin, nickel, or chrome.

54. The method of claim 51, wherein the coating is a non-conductive material.

55. The method of claim 54, wherein the coating is formed from plastic or rubber.

56. The method of claim 46, wherein the magnet is attached using a mount.

57. The method of claim 56, wherein the mount is selected from the group consisting of: an adhesive material, brackets, and a hook and loop fastener.

58. The apparatus of claim 56, wherein the mount includes a member having an adhesive coating on two opposing surfaces.

59. The apparatus of claim 56, wherein the mount includes a corrugated tie.

* * * * *